US011564296B2

(12) United States Patent
Molina Hernandez

(10) Patent No.: US 11,564,296 B2
(45) Date of Patent: Jan. 24, 2023

(54) STOCHASTIC FREQUENCY PULSE MODULATION FOR LIGHT-EMITTING DIODE DRIVERS

(71) Applicant: Analog Devices International Unlimited Company, Limerick (IE)

(72) Inventor: Isaac Molina Hernandez, Valencia (ES)

(73) Assignee: ANALOG DEVICES INTERNATIONAL UNLIMITED COMPANY, Limerick (IE)

( * ) Notice: Subject to any disclaimer, the term of this patent is extended or adjusted under 35 U.S.C. 154(b) by 211 days.

(21) Appl. No.: 17/174,704

(22) Filed: Feb. 12, 2021

(65) Prior Publication Data

US 2022/0264719 A1 Aug. 18, 2022

(51) Int. Cl.
*H05B 45/325* (2020.01)
*H05B 45/10* (2020.01)

(52) U.S. Cl.
CPC ..... *H05B 45/325* (2020.01); *H05B 45/10* (2020.01)

(58) Field of Classification Search
CPC ..... H05B 45/10; H05B 45/325
See application file for complete search history.

(56) References Cited

U.S. PATENT DOCUMENTS 6,580,260 B2 6/2003 Takita
6,924,757 B2 8/2005 Adams et al.
8,339,068 B2 12/2012 Simmers
10,334,672 B2 * 6/2019 Van Ess ..... H05B 45/10
10,652,981 B1 * 5/2020 De Cicco ..... H05B 45/325
11,006,490 B2 * 5/2021 Zhang ..... H05B 45/44
11,330,687 B2 * 5/2022 Krattiger ..... H05B 45/10
2020/0128636 A1 * 4/2020 De Cicco ..... H05B 45/10
2020/0413511 A1 * 12/2020 Krattiger ..... H05B 45/10

FOREIGN PATENT DOCUMENTS

CN 112888104 A * 6/2021
CN 114630469 A * 6/2022
EP 2456286 5/2012
(Continued)

OTHER PUBLICATIONS

Wojtkowski et al., *Stochastic Pulse Density Modulation for a Power LED Driver*, Photonics Letters of Poland, vol. 12 (2), 2020, 3 pages.
(Continued)

*Primary Examiner* — Raymond R Chai
(74) *Attorney, Agent, or Firm* — Akona IP PC

(57) ABSTRACT

Systems and methods that enable LED drivers to generate drive signals by implementing a modulation technique referred to herein as "stochastic frequency pulse modulation" (SFPM) are disclosed. The SFPM is based on randomly increasing or decreasing, during every cycle of a drive signal, the amount of time the drive signal is high or low, tracking the deviation of the total amount of time (i.e., for multiple cycles) that the drive signal is high or low from what it should be to provide to a LED a target average power dictated by a target dimming level, and using the tracking to set limits of ranges from which the durations of the time periods when the drive signal is high or low may be randomly selected.

20 Claims, 3 Drawing Sheets

(56) References Cited

FOREIGN PATENT DOCUMENTS

EP 2936929 A2 * 10/2015 ..... H05B 33/0854

OTHER PUBLICATIONS

Gulati, *Modulation Techniguesfor LED Dimming*, Cypress Perform, Oct. 22, 2008, 10 pages.
Stapelbroek, *Higher Order Feedback Loop fora Pulse Width Modulator*, University of Twente, Faculty of Electrical Engineering, Mathematics & Computer Science, Jun. 2006, 96 pages.
*Stochastic Signal Density Modulation*, Wikipedia, Dec. 11, 2020, 4 pages.

* cited by examiner

STOCHASTIC FREQUENCY PULSE MODULATION FOR LIGHT-EMITTING DIODE DRIVERS

TECHNICAL FIELD OF THE DISCLOSURE

The present disclosure generally relates to the field of electronic circuits and, more particularly, to systems and methods for light-emitting diode (LED) drivers applying modulation to generate drive signals for LEDs.

BACKGROUND

LED drivers are components that generate drive signals for LEDs to provide power to the LEDs. A drive signal generated by an LED driver controls electrical current through one or more LEDs, causing these LEDs to emit light (e.g., in the time periods when the drive signal is high) or not emit light (e.g., in the time periods when the drive signal is low). By modifying the duration of when LEDs emit light and when the LEDs do not emit light, a technique known as "modulation," the LEDs may be dimmed as desired.

Designing an LED driver is not a trivial task because each application may have different needs in performance, power, cost and size. Improvements in providing LED drivers are always desired.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DESCRIPTION OF EXAMPLE EMBODIMENTS OF THE DISCLOSURE

Overview

Figure 1:
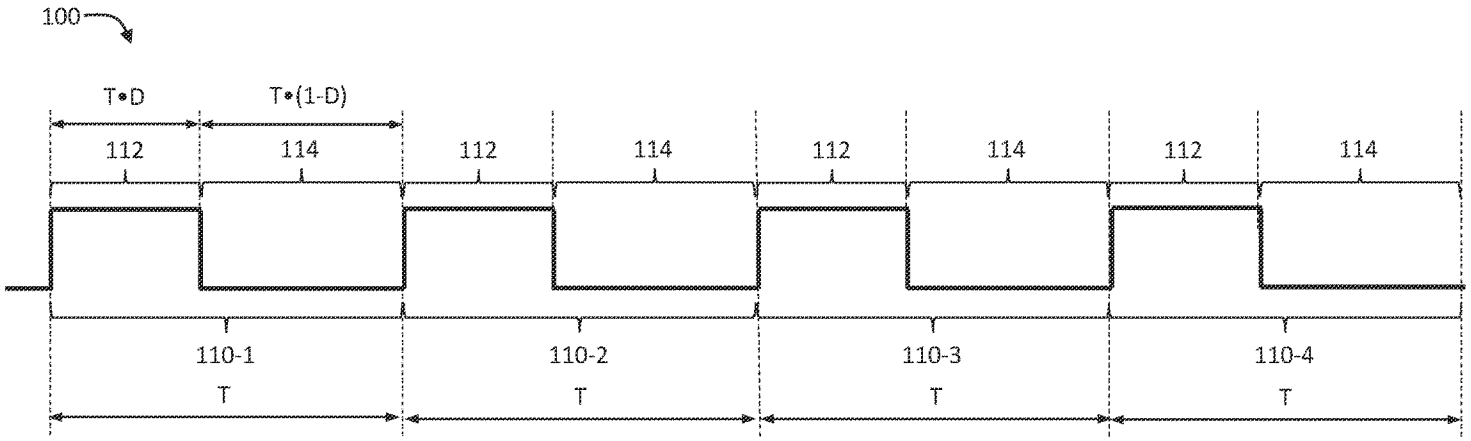
FIG. 1 provides an example timing diagram for a periodic drive signal with a constant duty cycle D.

The systems, methods, and devices of this disclosure each have several innovative aspects, no single one of which is solely responsible for all of the desirable attributes disclosed herein. Details of one or more implementations of the subject matter described in this specification are set forth in the description below and the accompanying drawings.

For purposes of illustrating stochastic frequency pulse modulation for LED drivers, proposed herein, it might be useful to first understand phenomena that may come into play in LED drivers. The following foundational information may be viewed as a basis from which the present disclosure may be properly explained. Such information is offered for purposes of explanation only and, accordingly, should not be construed in any way to limit the broad scope of the present disclosure and its potential applications.

One common modulation technique employed by conventional LED drivers to dim LEDs is pulse width modulation (PWM). As the name suggests, PWM involves modifying the pulse width of the drive signal to dim the LEDs as needed.

Embodiments of the present disclosure are based on realization that using PWM is associated with some shortcomings that may compromise performance of LEDs and, therefore, be unacceptable in certain implementations. For example, PWM may be associated with visible flicker of the LEDs. In order to overcome this shortcoming (i.e., in order to avoid or at least reduce the visible flicker), frequencies of the PWM drive signals need to be at least 120 hertz (Hz), or even at least 300 Hz. In another example, PWM may be associated with audible noise because frequencies greater than 1 kilohertz (kHz) can be audible due to the regulator inductor working as a speaker. Yet other shortcomings of PWM include maximum frequency components (efficiency of the switch regulator depends on the width of the PWM pulses) and electromagnetic interference (EMI) generated by the PWM.

To improve on one or more shortcomings described above, embodiments of the present disclosure provide systems and methods that enable LED drivers to generate drive signals by implementing a modulation technique referred to herein as "stochastic frequency pulse modulation" (SFPM). The SFPM is based on randomly increasing or decreasing, during every cycle of a drive signal, the amount of time (i.e., a duration of a time period) the drive signal is high or low, tracking the deviation of the total amount of time (i.e., for multiple cycles) that the drive signal is high or low from what it should be to provide to a LED a target average power dictated by a target dimming level, and using the tracking to set limits of ranges from which the durations of the time periods when the drive signal is high or low may be randomly selected. The name SFPM arises from the fact, in such a drive signal, pulses are modulated (hence, "pulse modulation") in a way that there is no single, fixed frequency of pulses of the drive signal in consecutive cycles (hence, "stochastic frequency"). Applying SFPM to generate a drive signal for an LED (in the following, unless stated otherwise, reference to a single LED is also applicable to a plurality, rather than only one, of LEDs) allows achieving a target amount of average power delivered to the LED in a manner that may eliminate or at least reduce one or more of the shortcomings associated with other LED driver modulation techniques, such as visible flicker, audible noise, maximum frequency components, and EMI.

In one aspect of the present disclosure, an example LED driver configured to implement SFPM is described. The LED driver may include a drive signal generator, configured to generate a drive signal for driving an LED. The drive signal includes a plurality of consecutive cycles, where each cycle includes what is referred to in the following as an "ON period" and an "OFF period," defined so that, in each cycle, the drive signal has an ON value (e.g., a high value, e.g., a value corresponding to digital logic 1) for a duration of the ON period of the cycle and the drive signal has an OFF value (e.g., a low value, e.g., a value corresponding to digital logic 0) fora duration of the OFF period of the cycle. In order for such an LED driver to implement SFPM, the LED driver may further include a controller, configured to control the drive signal generator to generate various cycles i (each of duration $T_i$), where i is an integer greater than zero indicative of a given, e.g., current, cycle of the plurality of consecutive cycles of the drive signal. In particular, the controller is configured to control the drive signal generator to generate a current cycle so that the duration of the ON period of the current cycle is based on a value of an ON variable (designated in the following as $n_i$) for the current cycle and so that the duration of the OFF period of the current cycle is based on a value of an OFF variable (designated in the following as $m_i$) for the current cycle. To that end, the controller is configured to determine the value of the ON variable for the current cycle by setting a range for the values of the ON variable for the current cycle (said range referred to herein as an "ON variable range") based on a parameter indicative of the values of the ON variable for the previous cycles of the drive signal. The controller is then configured to select the value of the ON variable for the current cycle from the set ON variable range. Similarly, the controller is configured to determine the value of the OFF variable for the current cycle by setting a range for the values of the OFF variable for the current cycle (said range referred to herein as an "OFF variable range") based on a parameter indicative of the values of the OFF variable for the previous cycles. The controller is then configured to select the value of the OFF variable for the current cycle from the set OFF variable range.

As will be appreciated by one skilled in the art, at least some aspects of the present disclosure, in particular at least some aspects of SFPM for LED drivers as described herein, may be embodied in various manners, e.g., as a method, a system, a computer program product, or a computer-readable storage medium. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." At least some functions described in this disclosure may be implemented as an algorithm executed by one or more hardware processing units, e.g., one or more microprocessors of one or more computers. In various embodiments, different steps, and portions of the steps, of each of the methods described herein may be performed by different processing units. Furthermore, aspects of the present disclosure may take the form of a computer program product embodied in one or more computer-readable medium(s), preferably non-transitory, having computer-readable program code embodied, e.g., stored, thereon. In various embodiments, such a computer program may, for example, be downloaded (updated) to the existing devices and systems (e.g., to the existing LED drivers and/or their controllers, etc.) or be stored upon manufacturing of these devices and systems.

The following detailed description presents various descriptions of specific certain embodiments. However, the innovations described herein can be embodied in a multitude of different ways, for example, as defined and covered by the claims or select examples. In the following description, reference is made to the drawings, where like reference numerals can indicate identical or functionally similar elements. It will be understood that elements illustrated in the drawings are not necessarily drawn to scale. Moreover, it will be understood that certain embodiments can include more elements than illustrated in a drawing and/or a subset of the elements illustrated in a drawing. Further, some embodiments can incorporate any suitable combination of features from two or more drawings.

The description may use the phrases "in an embodiment" or "in embodiments," which may each refer to one or more of the same or different embodiments. Unless otherwise specified, the use of the ordinal adjectives "first," "second," and "third," etc., to describe a common object, merely indicate that different instances of like objects are being referred to and are not intended to imply that the objects so described must be in a given sequence, either temporally, spatially, in ranking or in any other manner. Furthermore, for the purposes of the present disclosure, the phrase "A and/or B" or notation "A/B" means (A), (B), or (A and B), while the phrase "A, B, and/or C" means (A), (B), (C), (A and B), (A and C), (B and C), or (A, B, and C). As used herein, the notation "A/B/C" means (A, B, and/or C). The term "between," when used with reference to measurement ranges, is inclusive of the ends of the measurement ranges.

Various aspects of the illustrative embodiments are described using terms commonly employed by those skilled in the art to convey the substance of their work to others skilled in the art. For example, the term "random" in context of randomly selecting a value from a range of values (e.g., randomly selecting the duration of the ON period or the duration of the OFF period, or randomly selecting values to modify said durations, as described herein) refers to, e.g., using a computer-implemented random number generator or any algorithm for generating a value so that a sequence of such values would have properties that approximate the properties of sequences of random numbers. Since computer-based random number generators are almost always pseudo-random number generators, references to "random" selection of values include selecting values pseudo-randomly.

In another example, the term "connected" means a direct electrical connection between the things that are connected, without any intermediary devices/components, while the term "coupled" means either a direct electrical connection between the things that are connected, or an indirect connection through one or more passive or active intermediary devices/components. In yet another example, the term "circuit" means one or more passive and/or active components that are arranged to cooperate with one another to provide a desired function. Sometimes, in the present descriptions, the term "circuit" or the term "signal" may be omitted. If used, the terms "substantially," "approximately," "about," etc., may be used to generally refer to being within +/−20% of a target value, e.g., within +/−10% of a target value, based on the context of a particular value as described herein or as known in the art.

Other features and advantages of the disclosure will be apparent from the following description and the claims.

Explanations of Example SFPM

FIG. 1 provides an example timing diagram for a periodic drive signal 100 with a constant duty cycle D. The drive signal 100 has a plurality of consecutive cycles 110, four of which are shown in FIG. 1 as cycles 110-1 through 110-4. Because the drive signal 100 is a periodic signal, the duration of each cycle is the same, and may be designated as a time period T. As also shown in FIG. 1, each cycle 110 has an ON period 112 (i.e., a period when the drive signal 100 has a certain ON value, e.g., a high value as illustrated in FIG. 1) and an OFF period 114 (i.e., a period when the drive signal 100 has a certain OFF value, e.g., a low value as illustrated in FIG. 1). As used herein, the term "duty cycle" (D) (alternatively referred to as "power cycle") refers to the fraction of one period in which a signal or system is active. Duty cycle is commonly expressed as a percentage or a ratio. A period is the time it takes for a signal to complete an ON-and-OFF cycle. Because the drive signal 100 has a constant duty cycle D, the duration of each ON period 112 is T·D, while the duration of each OFF period 114 is T·(1−D).

Figure 2:
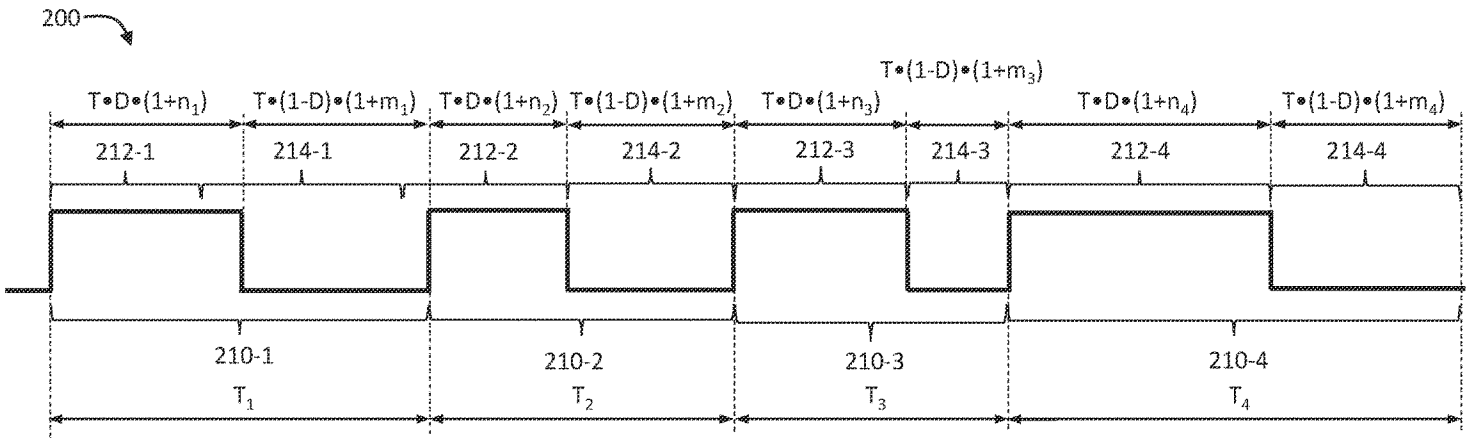
FIG. 2 provides an example timing diagram for a drive signal implementing stochastic frequency pulse modulation, according to some embodiments of the present disclosure.

FIG. 2 provides an example timing diagram for a drive signal 200 implementing SFPM, according to some embodiments of the present disclosure. Similar to the drive signal 100, the drive signal 200 has a plurality of consecutive cycles 210, four of which are shown in FIG. 2 as cycles 210-1 through 210-4. In contrast to the drive signal 100, the drive signal 200 is not a periodic signal, which means that the durations of different cycles 210 do not generally have to be the same, and the duration of each cycle 210 may be designated as a time period $T_i$. As used herein, the subscript "i" refers to a value for a particular cycle **210-*i***, where i is an integer greater than zero.

As also shown in FIG. 2, each cycle 210 has an ON period 212 (i.e., a period when the drive signal 200 has a certain ON value, e.g., a high value as illustrated in FIG. 2) and an OFF period 214 (i.e., a period when the drive signal 200 has a certain OFF value, e.g., a low value as illustrated in FIG. 2). In contrast to the drive signal 100, the drive signal 200 does not have a constant duty cycle D. Rather, for each cycle 210, the duration of the ON period 212 may be modified by an ON variable $n_i$, while the duration of the OFF period may be modified by an OFF variable $m_i$. For example, in some embodiments, the durations of the ON and OFF periods 212, 214 for different cycles 210 may be modified based on what they would have been for a target duty cycle D and for a periodic drive signal with a period T (with the nominal values D and T being as described with reference to FIG. 1). This means that, instead of the duration of the ON period 212 being T·D (as it was for the ON period 112 in the drive signal 100 of FIG. 1), the duration of the ON period **212-*i* of a given cycle i of the drive signal 200 may be modified by the ON variable $n_i$ to be $T \cdot D \cdot (1+n_i)$, as shown in FIG. 2 illustrating that the duration of the ON period 212-1 is $T \cdot D \cdot (1+n_i)$, the duration of the ON period 212-2 is $T \cdot D \cdot (1+n_2)$, and so on. This also means that, instead of the duration of the OFF period 214 being T·(1−D) (as it was for the OFF period 114 in the drive signal 100 of FIG. 1), the duration of the OFF period 214-*i* of a given cycle i of the drive signal 200 may be modified by the OFF variable $m_i$ to be $T \cdot (1-D) \cdot (1+m_i)$, as shown in FIG. 2 illustrating that the duration of the OFF period 214-1 is $T \cdot (1-D) \cdot (1+m_i)$, the duration of the OFF period 214-2** is $T \cdot (1-D) \cdot (1+m_2)$, and so on.

Having a drive signal in which the duration of each ON period 212 and the duration of each OFF period 214 (i.e., the durations of periods 212 and 214 for each of the cycles 210) may be modified by a respective variable (e.g., by the ON variable $n_i$ and the OFF variable $m_i$), as is shown with the example of the drive signal 200 is an example of applying SFPM to generate the drive signal. In order to generate such a drive signal, an LED driver may include at least a drive signal generator, configured to generate the drive signal, and further include a controller, configured to control the durations of the ON periods 212 and the OFF periods 214 for different cycles 210 of the drive signal 200.

Figure 3:
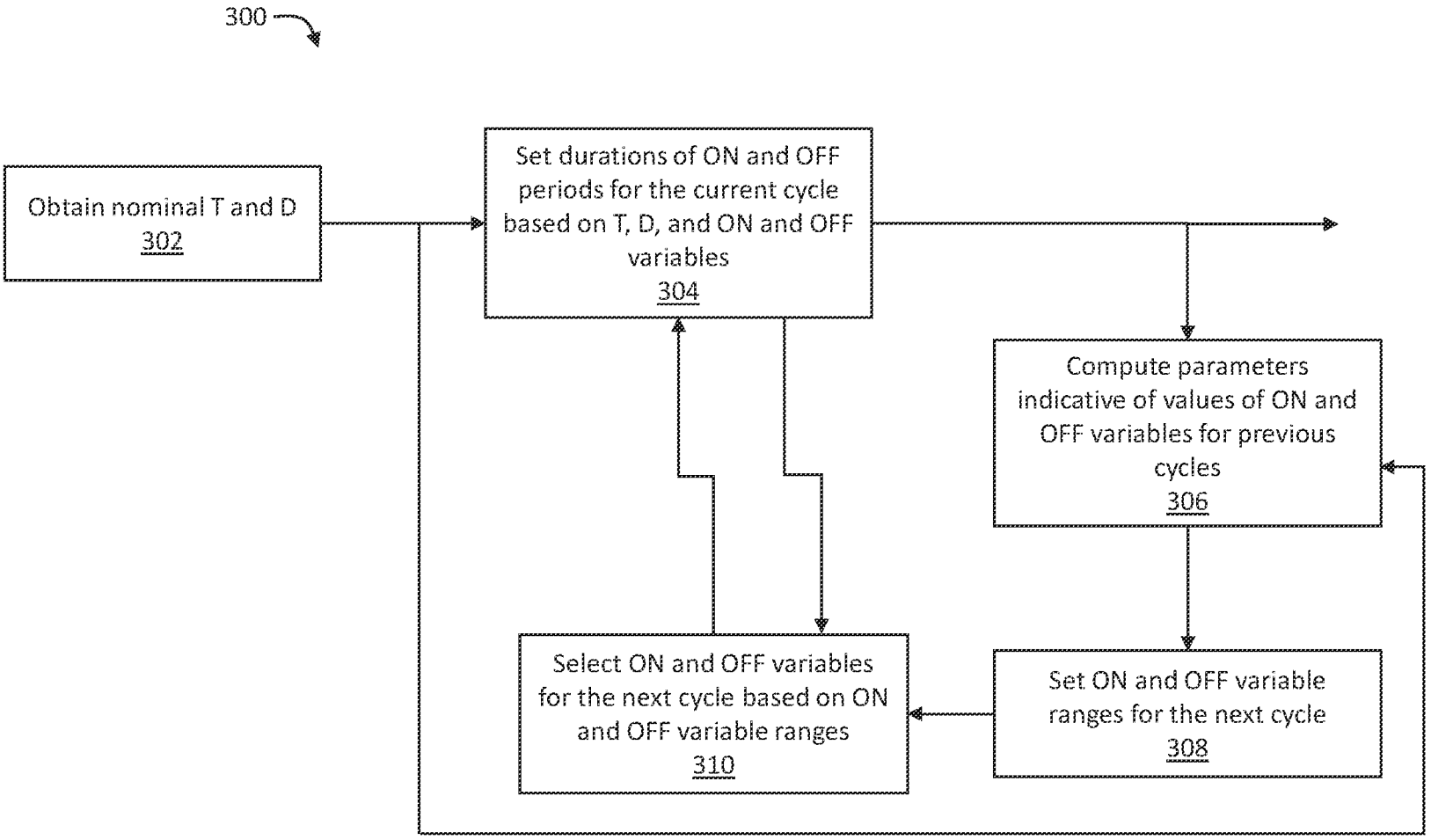
FIG. 3 provides a flow diagram illustrating a method for generating a drive signal for an LED using stochastic frequency pulse modulation, according to some embodiments of the present disclosure.

FIG. 3 is a flow diagram illustrating a method 300 for generating a drive signal for an LED using SFPM, according to some embodiments of the present disclosure. The method may be implemented by any LED driver (e.g., an LED driver 402, shown in FIG. 4) that includes, or is communicatively coupled to, a controller (e.g., a controller 406, shown in FIG. 4), as described herein. Although the method 300 is described with reference to system components of the system shown in FIG. 4, any system, configured to perform operations of the method 300, in any order, is within the scope of the present disclosure.

As shown in FIG. 3, the method 300 may begin with a process 302, which includes the LED driver obtaining nominal values of the cycle period T and the duty cycle D. The values of T and D may be as those described with reference to FIG. 1, and they may be referred to as "nominal" because they may generally define how much power is provided to the LED with a given drive signal having the cycle period T and the duty cycle D. In various embodiments, the LED driver may obtain the nominal values of the cycle period D and the duty cycle D by accessing them from a memory (e.g., a memory 410, shown in FIG. 4), by setting these values based on some design criteria (e.g., based on some information provided by a user or based on some information about the operation of an LED system for which the drive signal is being generated), by receiving these values from some external source (e.g., user input), etc.

The method 300 may then continue with a process 304, in which the LED driver (e.g., the controller of the LED driver) may use the nominal values of T and D obtained in the process 302, as well as the values of ON and OFF variables set in a process 310 (described below), to set durations of the ON period 212 and the OFF period 214 for the current cycle. For example, in the process 304 the LED driver may set the duration of the ON period **212-*i* of the current cycle i of the drive signal 200 to be $T \cdot D \cdot (1+n_i)$ and may set the duration of the OFF period 214-*i* of the current cycle i of the drive signal 200 to be $T \cdot (1-D) \cdot (1+m_i)$, as shown in FIG. 2. Although not specifically shown in FIG. 3, a drive signal generator of the LED driver may then generate the current cycle 210 with the durations of the ON period 212 and the OFF period 214 set in the process 304**.

The method 300 may also include a process 306, which includes the LED driver (e.g., the controller of the LED driver) computing a parameter indicative of the values of the ON variable (n) for at least a subset, or all of, the previous cycles of the drive signal 200 and a parameter indicative of the values of the OFF variable (m) for at least a subset, or all of, the previous cycles of the drive signal 200. In some embodiments, such parameters may be averages.

The method 300 may then proceed with a process 308, which includes the LED driver (e.g., the controller of the LED driver) setting ON and OFF variable ranges based on the parameters computed in the process 306. For example, in some embodiments, the ON variable range may be set in the process 306 so that, after the value of the ON variable for the current cycle has been selected from the ON variable range and the current cycle becomes one of the previous cycles (i.e., when the current cycle is over and becomes the latest cycle added to the previous cycles), the parameter (e.g., the average) indicative of the values of the ON variable for the previous cycles satisfies one or more ON parameter criteria. In another example, in some embodiments, the OFF variable range may be set in the process 306 so that, after the value of the OFF variable for the current cycle has been selected from the OFF variable range and the current cycle becomes one of the previous cycles, the parameter (e.g., the average) indicative of the values of the OFF variable for the previous cycles satisfies one or more OFF parameter criteria. What such criteria could be may depend on how exactly the parameters computed in the process 306 are defined (e.g., whether the parameter is an average) and on how the duration of the ON and OFF periods 212, 214 are set based on the ON and OFF variables. For example, if the duration of the ON period 212 is substantially equal to $T \cdot D \cdot (1+n_i)$, where $n_i$ and is the value of the ON variable for the current cycle, and the parameter indicative of the values of the ON variable for the previous cycles is an average of the values of the ON variable for the previous cycles, then the one or more ON parameter criteria may include that the average of the values of the ON variable for the previous cycles is about zero or is about within a certain acceptable tolerance window centered at zero. Such a criteria means that, on average the duration of the ON periods 212 should be about T·D, which is the value of $T \cdot D \cdot (1+n_i)$ when the average of $n_i$ for multiple previous cycles is 0. Similarly, if the duration of the OFF period 214 is substantially equal to $T \cdot (1-D) \cdot (1+m_i)$, where $m_i$ and is the value of the OFF variable for the current cycle, and the parameter indicative of the values of the OFF variable for the previous cycles is an average of the values of the OFF variable for the previous cycles, then the one or more OFF parameter criteria may include that the average of the values of the OFF variable for the previous cycles is about zero or is about within a certain acceptable tolerance window centered at zero. Such a criteria means that, on average the duration of the OFF periods 214 should be about T·(1−D), which is the value of $T \cdot (1-D) \cdot (1+m_i)$ when the average of $m_i$ for multiple previous cycles is 0. On the other hand, if the duration of the ON/OFF periods is defined differently, then the criteria may be different. For example, if the duration of the ON period 212 is substantially equal to $T \cdot D \cdot n_i$, then the one or more ON parameter criteria may include that the average of the values of the ON variable for the previous cycles is about one or is about within a certain acceptable tolerance window centered at one. Such a criteria means that, on average the duration of the ON periods 212 should be about T·D, which is the value of $T \cdot D \cdot n_i$ when the average of $n_i$ for multiple previous cycles is 1. Similarly, if the duration of the OFF period 214 is substantially equal to $T \cdot (1-D) \cdot m_i$, then the one or more OFF parameter criteria may include that the average of the values of the OFF variable for the previous cycles is about one or is about within a certain acceptable tolerance window centered at one. Such a criteria means that, on average the duration of the OFF periods 214 should be about T·(1−D), which is the value of $T \cdot (1-D) \cdot m_i$ when the average of $m_i$ for multiple previous cycles is 1.

The method 300 may then proceed with a process 310, which includes the LED driver (e.g., the controller of the LED driver) selecting ON and OFF variables based on the ON and OFF variable ranges set in the process 308. For example, in some embodiments, the process 310 may include randomly selecting a value of an ON variable for the next cycle from the ON variable range set in the process 308 and/or randomly selecting a value of an OFF variable for the next cycle from the OFF variable range set in the process 308. The ON and OFF variables set in the process 310 may then be used in the process 304 for the next current cycle. Thus, the processes 304-310 may be performed iteratively for each new current cycle of a drive signal (e.g., the drive signal 200) generated by the LED driver.

Implementing SFPM as describes herein may be described as:

$$\bar{y} = \frac{1}{T}\left(\int_0^{DT(1+n)} y_{max} \cdot dt + \frac{1}{T}\int_{DTn}^{Tm(1+m)} y_{min} \cdot dt\right)$$

where $\bar{y}$ is the average of the drive signal 200, $y_{max}$, is the ON value of the drive signal 200, $y_{min}$ is the OFF value of the drive signal 200, and D and T are as described above. If the method 300 can make sure the average of n and m is 0, then the average of y shall also be the expected average.

Figure 4:
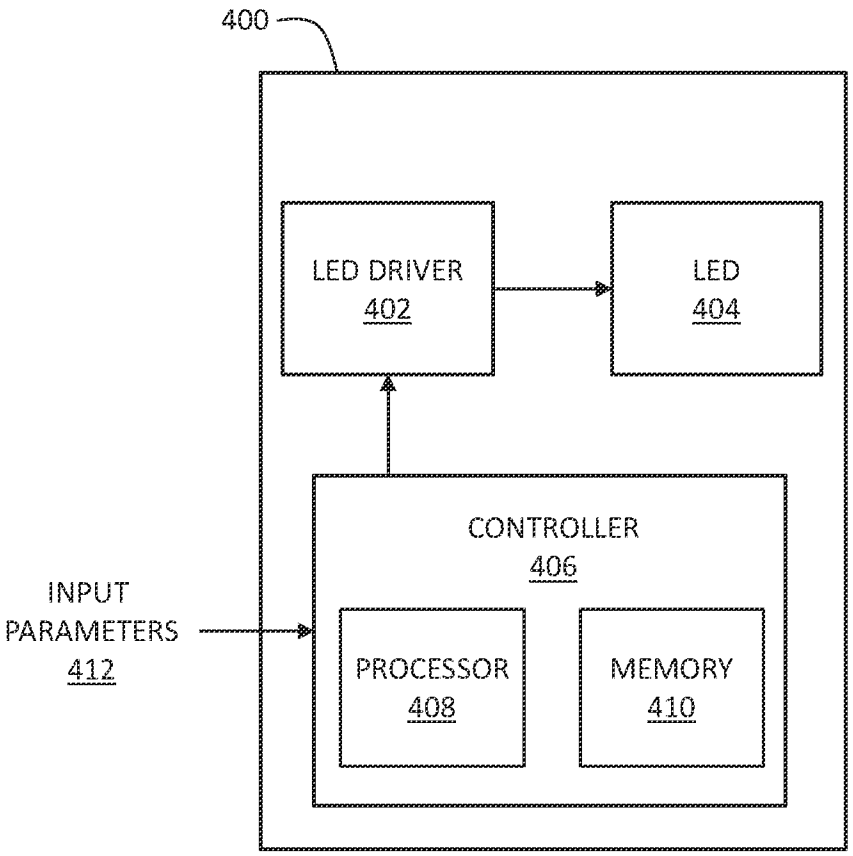
FIG. 4 provides a schematic block diagram illustrating a system in which one or more LED drivers configured to implement stochastic frequency pulse modulation may be implemented, according to some embodiments of the present disclosure.

FIG. 4 provides a schematic block diagram illustrating a system 400 in which one or more LED drivers configured to implement SFPM may be implemented, according to some embodiments of the present disclosure. As shown in FIG. 4, the system may include an LED driver 402, an LED 404, and a controller 406. The LED driver 402 may be configured to apply SFPM to generate a drive signal to drive the LED 404. The controller 406 may control at least portions of operation of the LED driver 402, in particular, control aspects of the LED driver 402 implementing SFPM in generating drive signals for the LED 404. For example, the controller 406 may perform operations described above with reference to FIG. 3. To that end, the controller 406 may include at least a processor 408 and a memory 410, and may have access to input parameters 412, which may, e.g., include the nominal values of T and D, described above.

In some embodiments, the processor 408, e.g., a hardware processor 408, may be coupled to the memory 410 through a system bus. As such, the controller 406 may store program code within the memory 410. The processor 408 may execute the program code accessed from the memory 410 via a system bus. In one aspect, the controller 406 may be implemented as a computer that is suitable for storing and/or executing program code. It should be appreciated, however, that the controller 406 may be implemented in the form of any system including a processor and a memory that is capable of performing the functions described within this disclosure.

In some embodiments, the processor 408 can execute software or an algorithm to perform the activities as discussed in this specification, in particular activities related to SFPM for LED drivers, e.g., according to the method 300, described herein. The processor 408 may include any combination of hardware, software, or firmware providing programmable logic, including by way of non-limiting example a microprocessor, a digital signal processor (DSP), a field-programmable gate array (FPGA), a programmable logic array (PLA), an integrated circuit (IC), an application specific IC (ASIC), or a virtual machine processor. The processor 408 may be communicatively coupled to the memory 410, for example in a direct-memory access (DMA) configuration, so that the processor 408 may read from or write to the memory 410.

In general, the memory 410 may include any suitable volatile or non-volatile memory technology, including double data rate (DDR) random access memory (RAM), synchronous RAM (SRAM), dynamic RAM (DRAM), flash, read-only memory (ROM), optical media, virtual memory regions, magnetic or tape memory, or any other suitable technology. Unless specified otherwise, any of the memory elements discussed herein should be construed as being encompassed within the broad term "memory." The information being measured, processed, tracked or sent to or from any of the components of the controller 406 could be provided in any database, register, control list, cache, or storage structure, all of which can be referenced at any suitable timeframe. Any such storage options may be included within the broad term "memory" as used herein. Similarly, any of the potential processing elements, modules, and machines described herein should be construed as being encompassed within the broad term "processor." Each of the elements shown in the present figures, e.g., any of the circuits/components shown in FIG. 4, can also include suitable interfaces for receiving, transmitting, and/or otherwise communicating data or information in a network environment so that they can communicate with, e.g., the controller 406 or analogous controllers of another one of these elements.

In certain example implementations, mechanisms for implementing SFPM for LED drivers as outlined herein may be implemented by logic encoded in one or more tangible media, which may be inclusive of non-transitory media, e.g., embedded logic provided in an ASIC, in DSP instructions, software (potentially inclusive of object code and source code) to be executed by a processor, or other similar machine, etc. In some of these instances, memory elements, such as the memory 410 shown in FIG. 4, can store data or information used for the operations described herein. This includes the memory elements being able to store software, logic, code, or processor instructions that are executed to carry out the activities described herein. A processor can execute any type of instructions associated with the data or information to achieve the operations detailed herein. In one example, the processors, such as the processor 408 shown in FIG. 4, could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., an FPGA, a DSP, an erasable programmable read-only memory (EPROM), an electrically erasable programmable read-only memory (EEPROM)) or an ASIC that includes digital logic, software, code, electronic instructions, or any suitable combination thereof.

In some embodiments, the memory 410 may store an application. It should be appreciated that the controller 406 may further execute an operating system (not shown in FIG. 4) that can facilitate execution of the application stored in the memory 410. The application stored in the memory 410 can be executed by the processor 408. Responsive to executing the application, the controller 406 may be configured to perform one or more operations or method steps described herein.

Although not specifically shown in FIG. 4, in some embodiments, input/output (I/O) can be coupled to the system 400 and/or the controller 406. Examples of input devices may include, but are not limited to, a keyboard, a pointing device such as a mouse, or the like. Examples of output devices may include, but are not limited to, a monitor or a display, speakers, or the like. In some embodiments, an output device coupled to the system 400 and/or the controller 406 may be any type of screen display, such as plasma display, liquid crystal display (LCD), organic light emitting diode (OLED) display, electroluminescent (EL) display, or any other indicator, such as a dial, barometer, or LED. In some implementations, the system may include a driver (not shown) for the output device. Input and/or output devices may be coupled to the system 400 and/or the controller 406 either directly or through intervening I/O controllers. In an embodiment, the input and the output devices may be implemented as a combined input/output device such as a touch sensitive display, also sometimes referred to as a "touch screen display" or simply "touch screen". In such an embodiment, input to the device may be provided by a movement of a physical object, such as a stylus or a finger of a user, on or near the touch screen display.

Although also not shown in in FIG. 4, a network adapter may also, optionally, be coupled to the system 400 and/or the controller 406 to enable it to become coupled to other systems, computer systems, remote network devices, and/or remote storage devices through intervening private or public networks. The network adapter may comprise a data receiver for receiving data that is transmitted by said systems, devices and/or networks to the system 400 and/or the controller 406, and a data transmitter for transmitting data from the system 400 and/or the controller 406 to said systems, devices and/or networks.

SELECT EXAMPLES

The following paragraphs provide various select examples of the embodiments disclosed herein.

Example 1 provides an LED driver that includes a drive signal generator and a controller. The drive signal generator is configured to generate a drive signal for driving an LED (which could include a plurality of LEDs), where the drive signal includes a plurality of consecutive cycles and where each cycle includes an ON period and an OFF period, where, in each cycle, the drive signal has an ON value for a duration of the ON period of the cycle and has an OFF value for a duration of the OFF period of the cycle. The controller is configured to control the drive signal generator to generate a current cycle (for example, a cycle i of a duration $T_i$, where i is an integer greater than zero) of the plurality of consecutive cycles of the drive signal so that the duration of the ON period of the current cycle is based on a value of an ON variable ($n_i$) for the current cycle and so that the duration of the OFF period of the current cycle is based on a value of an OFF variable ($m_i$) for the current cycle. The controller is further configured to determine the value of the ON variable for the current cycle by setting an ON variable range for the values of the ON variable for the current cycle based on a parameter indicative of the values of the ON variable for previous cycles of the plurality of consecutive cycles of the drive signal, and by selecting the value of the ON variable for the current cycle from the ON variable range. In addition, the controller is configured to determine the value of the OFF variable for the current cycle by setting an OFF variable range for the values of the OFF variable for the current cycle based on a parameter indicative of the values of the OFF variable for the previous cycles, and by selecting the value of the OFF variable for the current cycle from the OFF variable range.

Example 2 provides the LED driver according to example 1, where the parameter indicative of the values of the ON variable for the previous cycles is an average of the values of the ON variable for the previous cycles, and the parameter indicative of the values of the OFF variable for the previous cycles is an average of the values of the OFF variable for the previous cycles.

Example 3 provides the LED driver according to examples 1 or 2, where setting the ON variable range based on the parameter indicative of the values of the ON variable for the previous cycles includes setting the ON variable range so that, after the value of the ON variable for the current cycle has been selected from the ON variable range and the current cycle becomes one of the previous cycles (i.e., when the current cycle is over and becomes the latest cycle added to the previous cycles), the parameter indicative of the values of the ON variable for the previous cycles satisfies one or more ON parameter criteria.

Example 4 provides the LED driver according to example 3, where controlling the drive signal generator to generate the current cycle so that the duration of the ON period is based on the value of the ON variable for the current cycle includes controlling the drive signal generator to generate the current cycle so that the duration of the ON period is substantially equal to $T \cdot D \cdot (1+n_i)$, where T is a nominal period value (i.e., a period value that is applicable to all cycles of the drive signal), D is a nominal duty cycle (D) (i.e., a duty cycle value that is applicable to all cycles of the drive signal), and $n_i$ is the value of the ON variable for the current cycle. In such an LED driver, the parameter indicative of the values of the ON variable for the previous cycles is an average of the values of the ON variable for the previous cycles, and the one or more ON parameter criteria include that the average of the values of the ON variable for the previous cycles is within a tolerance window centered at zero.

Example 5 provides the LED driver according to example 3, where controlling the drive signal generator to generate the current cycle so that the duration of the ON period is based on the value of the ON variable for the current cycle includes controlling the drive signal generator to generate the current cycle so that the duration of the ON period is substantially equal to $T \cdot D \cdot n_i$, where T is a nominal period value (i.e., a period value that is applicable to all cycles of the drive signal), D is a nominal duty cycle (D) (i.e., a duty cycle value that is applicable to all cycles of the drive signal), and $n_i$ is the value of the ON variable for the current cycle. In such an LED driver, the parameter indicative of the values of the ON variable for the previous cycles is an average of the values of the ON variable for the previous cycles, and the one or more ON parameter criteria include that the average of the values of the ON variable for the previous cycles is within a tolerance window centered at one.

Example 6 provides the LED driver according to any one of the preceding examples, where selecting the value of the ON variable for the current cycle from the ON variable range includes randomly selecting the value of the ON variable for the current cycle from the ON variable range.

Example 7 provides the LED driver according to any one of the preceding examples, where setting the OFF variable range based on the parameter indicative of the values of the OFF variable for the previous cycles includes setting the OFF variable range so that, after the value of the OFF variable for the current cycle has been selected from the OFF variable range and the current cycle becomes one of the previous cycles (i.e., when the current cycle is over and becomes the latest cycle added to the previous cycles), the parameter indicative of the values of the ON variable for the previous cycles satisfies one or more OFF parameter criteria.

Example 8 provides the LED driver according to example 7, where controlling the drive signal generator to generate the current cycle so that the duration of the OFF period is based on the value of the OFF variable for the current cycle includes controlling the drive signal generator to generate the current cycle so that the duration of the OFF period is substantially equal to $T \cdot (1-D) \cdot (1+m_i)$, where T is a nominal period value (i.e., a period value that is applicable to all cycles of the drive signal), D is a nominal duty cycle (D) (i.e., a duty cycle value that is applicable to all cycles of the drive signal), and $m_i$ is the value of the OFF variable for the current cycle. In such an LED driver, the parameter indicative of the values of the OFF variable for the previous cycles is an average of the values of the OFF variable for the previous cycles, and the one or more OFF parameter criteria include that the average of the values of the OFF variable for the previous cycles is within a tolerance window centered at zero.

Example 9 provides the LED driver according to example 7, where controlling the drive signal generator to generate the current cycle so that the duration of the OFF period is based on the value of the OFF variable for the current cycle includes controlling the drive signal generator to generate the current cycle so that the duration of the OFF period is substantially equal to $T \cdot (1-D) \cdot m_i$ where T is a nominal period value (i.e., a period value that is applicable to all cycles of the drive signal), D is a nominal duty cycle (D) (i.e., a duty cycle value that is applicable to all cycles of the drive signal), and $m_i$ is the value of the OFF variable for the current cycle. In such an LED driver, the parameter indicative of the values of the OFF variable for the previous cycles is an average of the values of the OFF variable for the previous cycles, and the one or more OFF parameter criteria include that the average of the values of the OFF variable for the previous cycles is within a tolerance window centered at one.

Example 10 provides the LED driver according to any one of the preceding examples, where selecting the value of the OFF variable for the current cycle from the OFF variable range includes randomly selecting the value of the OFF variable for the current cycle from the OFF variable range.

Example 11 provides a system that includes a controller configured to control a LED driver to generate a drive signal for driving an LED, where the drive signal includes a plurality of consecutive cycles and where each cycle includes an ON period and an OFF period. In each cycle, the drive signal has an ON value fora duration of the ON period of the cycle and has an OFF value for a duration of the OFF period of the cycle. The controller includes one or more circuits, configured to, for each cycle of the plurality of consecutive cycles, randomly select the duration of the ON period of the cycle from a range of durations of the ON period, where the range of durations of the ON period for the cycle is based on the durations of the ON period selected for previous cycles of the plurality of consecutive cycles; and randomly select the duration of the OFF period of the cycle from a range of durations of the OFF period, where the range of durations of the OFF period for the cycle is based on the durations of the OFF period selected for the previous cycles.

Example 12 provides the system according to example 11, where the one or more circuits of the controller are further configured to determine the range of durations of the ON period for the cycle so that, after the cycle becomes one of the previous cycles (i.e., for subsequent cycles), an average of the durations of the ON period selected for previous cycles is within a tolerance window centered at $T \cdot D$, where T is a nominal period value (i.e., a period value that is applicable to all cycles of the drive signal) and D is a nominal duty cycle (D) (i.e., a duty cycle value that is applicable to all cycles of the drive signal).

Example 13 provides the system according to example 12, where the controller further includes a memory, configured to store data indicative of the average of the durations of the ON period selected for the previous cycles.

Example 14 provides the system according to examples 12 or 13, where the one or more circuits of the controller are further configured to determine the range of durations of the OFF period for the cycle so that, after the cycle becomes one of the previous cycles, an average of the durations of the OFF period selected for previous cycles is within a tolerance window centered at $T \cdot (1-D)$.

Example 15 provides the system according to example 14, where the controller further includes a memory, configured to store data indicative of the average of the durations of the OFF period selected for the previous cycles.

Example 16 provides the system according to any one of examples 11-15, where a duration of each cycle is a sum of the duration of the ON period of the cycle and the duration of the OFF period of the cycle, and where different cycles of the plurality of consecutive cycles have different durations.

Example 17 provides the system according to any one of examples 11-16, where the system includes the LED driver.

Example 18 provides the system according to any one of examples 11-17, where the system includes the LED.

Example 19 provides a method for operating a LED driver to generate a drive signal for driving an LED, where the drive signal includes a plurality of consecutive cycles and where each cycle includes an ON period and an OFF period, where, in each cycle, the drive signal has an ON value for a duration of the ON period of the cycle and has an OFF value for a duration of the OFF period of the cycle. The method includes randomly selecting the duration of the ON period of a current cycle of the plurality of consecutive cycles from a range of durations of the ON period, where the range of durations of the ON period for the cycle is based on the durations of the ON period selected for previous cycles of the plurality of consecutive cycles; randomly selecting the duration of the OFF period of the current cycle from a range of durations of the OFF period, where the range of durations of the OFF period for the cycle is based on the durations of the OFF period selected for the previous cycles; and causing the LED driver to generate the current cycle of the drive signal.

Example 20 provides the method according to example 19, further including repeating steps of randomly selecting the duration of the ON period of the current cycle, randomly selecting the duration of the OFF period of the current cycle, and causing the LED driver to generate the current cycle for each cycle of the plurality of consecutive cycles.

In various further examples, the method according to examples 19 or 20 may include features of, or be implemented in, the LED driver according to any one of examples 1-10 or/and the system according to any one of examples 11-18.

Other Implementation Notes, Variations, and Applications

In the discussions of the embodiments above, components of a system, such as LEDs, controllers, and/or other components can readily be replaced, substituted, or otherwise modified in order to accommodate particular circuitry needs. Moreover, it should be noted that the use of complementary electronic devices, hardware, software, etc., offer an equally viable option for implementing the teachings of the present disclosure related to providing SFPM for LED drivers as described herein.

In one example embodiment, any number of electrical circuits of the present drawings may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of DSPs, microprocessors, supporting chipsets, etc.), computer-readable non-transitory memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In various embodiments, the functionalities described herein may be implemented in emulation form as software or firmware running within one or more configurable (e.g., programmable) elements arranged in a structure that supports these functions. The software or firmware providing the emulation may be provided on non-transitory computer-readable storage medium comprising instructions to allow a processor to carry out those functionalities.

In another example embodiment, the electrical circuits of the present drawings may be implemented as stand-alone modules (e.g., a device with associated components and circuitry configured to perform a specific application or function) or implemented as plug-in modules into application specific hardware of electronic devices. Note that particular embodiments of the present disclosure may be readily included in a system on a chip (SOC) package, either in part, or in whole. An SOC represents an IC that integrates components of a computer or other electronic system into a single chip. It may contain digital, analog, mixed-signal, and often radio frequency (RF) functions: all of which may be provided on a single chip substrate. Other embodiments may include a multi-chip-module (MCM), with a plurality of separate ICs located within a single electronic package and configured to interact closely with each other through the electronic package.

It is also imperative to note that all of the specifications, dimensions, and relationships outlined herein (e.g., the number and durations of cycles, or portions of cycles, of a drive signal illustrated in FIG. 2, the number of steps illustrated in FIG. 3, the number of components illustrated in FIG. 4) have only been offered for purposes of example and teaching only. Such information may be varied considerably without departing from the spirit of the present disclosure. It should be appreciated that the system can be consolidated in any suitable manner. Along similar design alternatives, any of the illustrated circuits, components, modules, and elements of the present drawings may be combined in various possible configurations, all of which are clearly within the broad scope of this specification. In the foregoing description, example embodiments have been described with reference to particular component arrangements. Various modifications and changes may be made to such embodiments without departing from the scope of the present disclosure. The description and drawings are, accordingly, to be regarded in an illustrative rather than in a restrictive sense.

The invention claimed is:

1. A light emitting diode (LED) driver, comprising:

a drive signal generator, configured to generate a drive signal for driving an LED, where the drive signal includes a plurality of consecutive cycles and where each cycle includes an ON period and an OFF period, where, in each cycle, the drive signal has an ON value for a duration of the ON period of the cycle and has an OFF value for a duration of the OFF period of the cycle; and a controller, configured to:

control the drive signal generator to generate a current cycle of the plurality of consecutive cycles of the drive signal so that the duration of the ON period of the current cycle is based on a value of an ON variable for the current cycle and so that the duration of the OFF period of the current cycle is based on a value of an OFF variable for the current cycle, determine the value of the ON variable for the current cycle by setting an ON variable range for the values of the ON variable for the current cycle based on a parameter indicative of the values of the ON variable for previous cycles of the plurality of consecutive cycles of the drive signal and by selecting the value of the ON variable for the current cycle from the ON variable range, and determine the value of the OFF variable for the current cycle by setting an OFF variable range for the values of the OFF variable for the current cycle based on a parameter indicative of the values of the OFF variable for the previous cycles and by selecting the value of the OFF variable for the current cycle from the OFF variable range.

2. The LED driver according to claim 1, wherein:

the parameter indicative of the values of the ON variable for the previous cycles is an average of the values of the ON variable for the previous cycles, and the parameter indicative of the values of the OFF variable for the previous cycles is an average of the values of the OFF variable for the previous cycles.

3. The LED driver according to claim 1, wherein setting the ON variable range based on the parameter indicative of the values of the ON variable for the previous cycles includes setting the ON variable range so that, after the value of the ON variable for the current cycle has been selected from the ON variable range and the current cycle becomes one of the previous cycles, the parameter indicative of the values of the ON variable for the previous cycles satisfies one or more ON parameter criteria.

4. The LED driver according to claim 3, wherein:

controlling the drive signal generator to generate the current cycle so that the duration of the ON period is based on the value of the ON variable for the current cycle includes controlling the drive signal generator to generate the current cycle so that the duration of the ON period is substantially equal to $T \cdot D \cdot (1+n_i)$, where T is a target period value, D is a target duty cycle, and $n_i$ is the value of the ON variable for the current cycle, the parameter indicative of the values of the ON variable for the previous cycles is an average of the values of the ON variable for the previous cycles, and the one or more ON parameter criteria include that the average of the values of the ON variable for the previous cycles is within a tolerance window centered at zero.

5. The LED driver according to claim 3, wherein:

controlling the drive signal generator to generate the current cycle so that the duration of the ON period is based on the value of the ON variable for the current cycle includes controlling the drive signal generator to generate the current cycle so that the duration of the ON period is substantially equal to $T \cdot D \cdot n_i$, where T is a target period value, D is a target duty cycle, and $n_i$ is the value of the ON variable for the current cycle, the parameter indicative of the values of the ON variable for the previous cycles is an average of the values of the ON variable for the previous cycles, and the one or more ON parameter criteria include that the average of the values of the ON variable for the previous cycles is within a tolerance window centered at one.

6. The LED driver according to claim 1, wherein selecting the value of the ON variable for the current cycle from the ON variable range includes using a random number generator or a pseudo-random number generator to select the value of the ON variable for the current cycle from the ON variable range.

7. The LED driver according to claim 1, wherein setting the OFF variable range based on the parameter indicative of the values of the OFF variable for the previous cycles includes setting the OFF variable range so that, after the value of the OFF variable for the current cycle has been selected from the OFF variable range and the current cycle becomes one of the previous cycles, the parameter indicative of the values of the ON variable for the previous cycles satisfies one or more OFF parameter criteria.

8. The LED driver according to claim 7, wherein:

controlling the drive signal generator to generate the current cycle so that the duration of the OFF period is based on the value of the OFF variable for the current cycle includes controlling the drive signal generator to generate the current cycle so that the duration of the OFF period is substantially equal to $T \cdot (1-D) \cdot (1+m_i)$, where T is a target period value, D is a target duty cycle, and $m_i$ is the value of the OFF variable for the current cycle, the parameter indicative of the values of the OFF variable for the previous cycles is an average of the values of the OFF variable for the previous cycles, and the one or more OFF parameter criteria include that the average of the values of the OFF variable for the previous cycles is within a tolerance window centered at zero.

9. The LED driver according to claim 7, wherein:

controlling the drive signal generator to generate the current cycle so that the duration of the OFF period is based on the value of the OFF variable for the current cycle includes controlling the drive signal generator to generate the current cycle so that the duration of the OFF period is substantially equal to $T \cdot (1-D) \cdot m_i$, where T is a target period value, D is a target duty cycle, and $m_i$ is the value of the OFF variable for the current cycle, the parameter indicative of the values of the OFF variable for the previous cycles is an average of the values of the OFF variable for the previous cycles, and the one or more OFF parameter criteria include that the average of the values of the OFF variable for the previous cycles is within a tolerance window centered at one.

10. The LED driver according to claim 1, wherein selecting the value of the OFF variable for the current cycle from the OFF variable range includes using a random number generator or a pseudo-random number generator to select the value of the OFF variable for the current cycle from the OFF variable range.

11. A system, comprising a controller configured to control a light emitting diode (LED) driver to generate a drive signal for driving an LED, where the drive signal includes a plurality of consecutive cycles and where each cycle includes an ON period and an OFF period, where, in each cycle, the drive signal has an ON value for a duration of the ON period of the cycle and has an OFF value for a duration of the OFF period of the cycle, the controller comprising:

one or more circuits, configured to, for each cycle of the plurality of consecutive cycles:

use a random number generator or a pseudo-random number generator to select the duration of the ON period of the cycle from a range of durations of the ON period, where the range of durations of the ON period for the cycle is based on the durations of the ON period selected for previous cycles of the plurality of consecutive cycles, use a random number generator or a pseudo-random number generator to select the duration of the OFF period of the cycle from a range of durations of the OFF period, where the range of durations of the OFF period for the cycle is based on the durations of the OFF period selected for the previous cycles.

12. The system according to claim 11, wherein the one or more circuits of the controller are further configured to determine the range of durations of the ON period for the cycle so that, after the cycle becomes one of the previous cycles, an average of the durations of the ON period selected for previous cycles is within a tolerance window centered at T·D, where T is a target period value and D is a target duty cycle.

13. The system according to claim 12, wherein the controller further includes a memory, configured to store data indicative of the average of the durations of the ON period selected for the previous cycles.

14. The system according to claim 12, wherein the one or more circuits of the controller are further configured to determine the range of durations of the OFF period for the cycle so that, after the cycle becomes one of the previous cycles, an average of the durations of the OFF period selected for previous cycles is within a tolerance window centered at T·(1−D).

15. The system according to claim 14, wherein the controller further includes a memory, configured to store data indicative of the average of the durations of the OFF period selected for the previous cycles.

16. The system according to claim 11, wherein a duration of each cycle is a sum of the duration of the ON period of the cycle and the duration of the OFF period of the cycle, and wherein different cycles of the plurality of consecutive cycles have different durations.

17. The system according to claim 11, wherein the system includes the LED driver.

18. The system according to claim 11, wherein the system includes the LED.

19. A method for operating a light emitting diode (LED) driver to generate a drive signal for driving an LED, where the drive signal includes a plurality of consecutive cycles and where each cycle includes an ON period and an OFF period, where, in each cycle, the drive signal has an ON value for a duration of the ON period of the cycle and has an OFF value for a duration of the OFF period of the cycle, the method comprising:

selecting the duration of the ON period of a current cycle of the plurality of consecutive cycles from a range of durations of the ON period, where the range of durations of the ON period for the cycle is based on the durations of the ON period selected for previous cycles of the plurality of consecutive cycles, selecting the duration of the OFF period of the current cycle from a range of durations of the OFF period, where the range of durations of the OFF period for the cycle is based on the durations of the OFF period selected for the previous cycles, and causing the LED driver to generate the current cycle of the drive signal.

20. The method according to claim 19, further including repeating steps of:

selecting the duration of the ON period of the current cycle, selecting the duration of the OFF period of the current cycle, and causing the LED driver to generate the current cycle for each cycle of the plurality of consecutive cycles.

* * * * *